US009759007B2

(12) United States Patent
Trpkovski

(10) Patent No.: US 9,759,007 B2
(45) Date of Patent: Sep. 12, 2017

(54) SPACER FOR RETAINING MUNTIN BARS AND METHOD OF ASSEMBLY

(71) Applicant: PDS IG Holding LLC, Prairie Du Sac, WI (US)

(72) Inventor: Paul Trpkovski, Green Cove Springs, FL (US)

(73) Assignee: PDS IG Holding, LLC, Prairie Du Sac, WI (US)

( * ) Notice: Subject to any disclaimer, the term of this patent is extended or adjusted under 35 U.S.C. 154(b) by 0 days.

(21) Appl. No.: 15/155,844

(22) Filed: May 16, 2016

(65) Prior Publication Data

US 2016/0340960 A1 Nov. 24, 2016

Related U.S. Application Data

(60) Provisional application No. 62/163,108, filed on May 18, 2015.

(51) Int. Cl.
*E06B 3/663* (2006.01)
*E06B 3/66* (2006.01)
*E06B 3/667* (2006.01)

(52) U.S. Cl.
CPC ..... *E06B 3/6604* (2013.01); *E06B 3/6675* (2013.01); *E06B 2003/6639* (2013.01)

(58) Field of Classification Search
CPC ..... E06B 3/6604; E06B 3/6675; E06B 2003/6639
See application file for complete search history.

(56) References Cited

U.S. PATENT DOCUMENTS

| | | | | |
|---|---|---|---|---|
| 3,023,864 | A | 3/1962 | Mostoller et al. | |
| 4,536,182 | A * | 8/1985 | Tatin | D06L 3/02 8/101 |
| 4,652,472 | A * | 3/1987 | Davies | E06B 3/6604 428/136 |
| 5,574,651 | A | 11/1996 | Rodney et al. | |
| 6,128,871 | A | 10/2000 | Corey et al. | |
| 6,425,221 | B1 * | 7/2002 | Reichert | E06B 3/6604 428/71 |
| 6,536,182 | B2 * | 3/2003 | France | E06B 3/24 428/34 |
| 6,651,304 | B2 | 11/2003 | McGlinchy et al. | |
| 7,076,927 | B2 | 7/2006 | Trpkovski et al. | |
| 8,001,742 | B2 | 8/2011 | Grismer et al. | |
| 2007/0157544 | A1 | 7/2007 | Zurn et al. | |
| 2009/0120035 | A1 | 5/2009 | Trpkovski | |

(Continued)

OTHER PUBLICATIONS

"Allmetal Muntin Bars webpage," pp. 1-2, Mar. 27, 2015, http://www.allmetalinc.com/Components/MuntinBars/aspx (1 page).

*Primary Examiner* — Jeanette E Chapman
(74) *Attorney, Agent, or Firm* — Pauly, DeVries, Smith & Deffner LLC

(57) ABSTRACT

Embodiments include a window assembly that includes a first sheet of a translucent, transparent or semi-transparent material; a second sheet of a translucent, transparent or semi-transparent material; a spacer extending from the first sheet to the second sheet and includes at least a first elongated strip having a first surface and wherein the spacer defines a muntin opening in the first surface of the first strip; and a muntin bar having a first end that is positioned within the muntin opening of the spacer. Other embodiments are also included herein.

18 Claims, 21 Drawing Sheets

(56) References Cited

U.S. PATENT DOCUMENTS

| | | | | |
|---|---|---|---|---|
| 2009/0120036 | A1 | 5/2009 | Trpkovski et al. | |
| 2011/0104512 | A1 | 5/2011 | Rapp et al. | |
| 2014/0113098 | A1* | 4/2014 | Rapp | E06B 3/66361 428/76 |

* cited by examiner

SPACER FOR RETAINING MUNTIN BARS AND METHOD OF ASSEMBLY

This application claims the benefit of U.S. Provisional Application No. 62/163,108, filed May 18, 2015, the contents of which are herein incorporated by reference.

FIELD OF THE TECHNOLOGY

The present application relates to spacers in window assemblies. More specifically, the present application relates to a spacer with an opening for a muntin bar.

SUMMARY

In some embodiments, a window assembly includes a first sheet of a translucent, transparent or semi-transparent material; a second sheet of a translucent, transparent or semi-transparent material; and a spacer extending from the first sheet to the second sheet. The spacer includes at least a first elongated strip having a first surface and the spacer defines a muntin opening in the first surface of the first strip. The assembly further includes a muntin bar having a first end that is positioned within the muntin opening of the spacer.

In some embodiments, the spacer defines an interior space and further comprises at least one filler positioned within the interior space of the spacer, the filler including a desiccant.

In some embodiments, the desiccant is a beaded desiccant.

In some embodiments, the muntin opening surrounds the entire perimeter of the muntin bar.

In some embodiments, at least one edge of the muntin opening is serrated.

In some embodiments, the spacer comprises a flap portion extending from the first surface at the muntin opening, wherein the flap portion extends into an interior space defined by the spacer.

In some embodiments, the flap portion located within the interior space is adjacent to the first end of the muntin bar.

In some embodiments, the spacer comprises a first flap and a second flap extending from the first surface at the muntin opening, wherein the first and second flaps extend into an interior space defined by the spacer.

In some embodiments, the first flap and second flap are substantially similar.

In some embodiments, the shape of a cross-section of the muntin bar is similar to the shape of the muntin opening.

In some embodiments, the muntin opening is at least 0.07 square inches.

In some embodiments, a spacer comprising at least a first elongated strip having a first surface, wherein the spacer defines at least part of a muntin opening in the first surface of the first strip, wherein the muntin opening is configured to receive an end of a muntin bar, is provided.

In some embodiments, the spacer defines an interior space and at least one filler positioned within the interior space of the spacer, the filler including a desiccant.

In some embodiments, the desiccant is a beaded desiccant.

In some embodiments, the muntin opening defines a closed perimeter.

In some embodiments, at least one edge of the muntin opening is serrated.

In some embodiments, the at least part of a muntin opening comprises three sides of a rectangle defining a flap portion configured to be bent down into an interior space defined by the spacer.

In some embodiments, the at least part of a muntin opening defines a first flap and a second flap configured to be bent down into an interior space defined by the spacer.

In some embodiments, the first flap and second flap are substantially similar.

In some embodiments, the muntin opening is covered by a portion of the first strip.

In some embodiments, the portion of the first surface that covers the muntin opening comprises a first flap and a second flap.

In some embodiments, the first flap and the second flap are substantially similar.

In some embodiments, a method of assembling a window assembly including a first muntin bar is provided. The method can include providing a spacer including a first strip; cutting at least a part of a perimeter of a muntin opening in the first strip of the spacer, wherein the muntin opening is configured to receive a first end of a first muntin bar; and inserting the first end of the first muntin bar into the muntin opening.

In some embodiments, the first strip comprises at least one flap covering at least a portion of the muntin opening.

In some embodiments, the method further includes inserting the first end of the first muntin bar into the muntin opening moves the at least one flap into an interior space defined by the spacer.

In some embodiments, the method can further include removing at least some debris from the window assembly, wherein the debris is a result from cutting the muntin bar opening.

In some embodiments, the method can further include the step of assembling a muntin bar grid from a plurality of muntin bars including the first muntin bar, wherein the step of cutting comprises cutting a plurality of muntin openings in the first strip of the spacer, wherein a number of muntin openings equals a number of muntin bar ends present in the muntin bar grid, wherein the step of inserting further comprises inserting each of the muntin bar ends into one of the plurality of muntin bar openings.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present application is defined by the appended claims and their legal equivalents.

BRIEF DESCRIPTION OF THE FIGURES

The technology may be more completely understood in connection with the following drawings, in which.

While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

Many window assemblies have muntin bars or muntin bar grids positioned in an interior space of the window assembly to increase the aesthetic appeal of the window assembly. The interior space of the window assembly is defined between a first sheet, a second sheet and a spacer that separates the first sheet and second sheet. During the manufacturing process of the window assembly, the spacer is formed into a spacer frame having the same shape as the window assembly, such as a rectangle. The spacer defines two or more muntin openings for receiving ends of the muntin bars. The muntin openings of the spacer retain the muntin bars in the desired position within the interior space of the window assembly. Examples of window assemblies including at least one muntin bar and examples of spacers for use with such window assemblies are described herein. Examples of manufacturing methods for window assemblies that include at least one muntin bar are also described herein.

Figure 1:
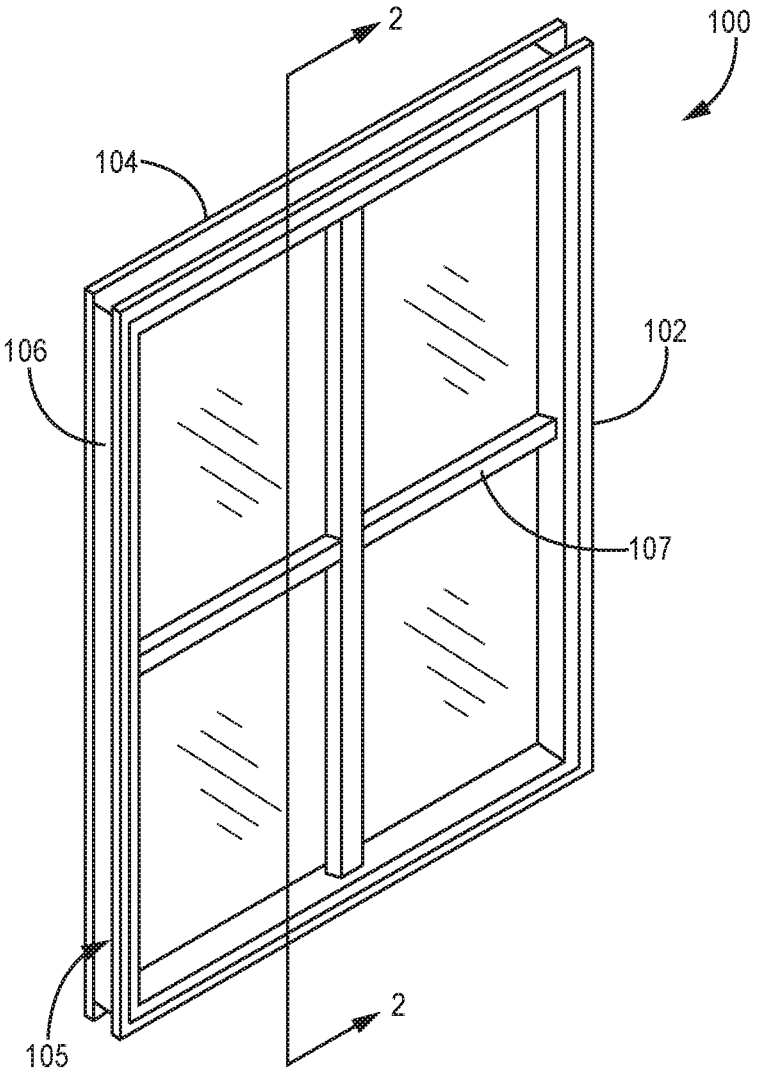
FIG. 1 is a perspective view of a window assembly including a muntin bar grid, according to some embodiments.
Figure 2:
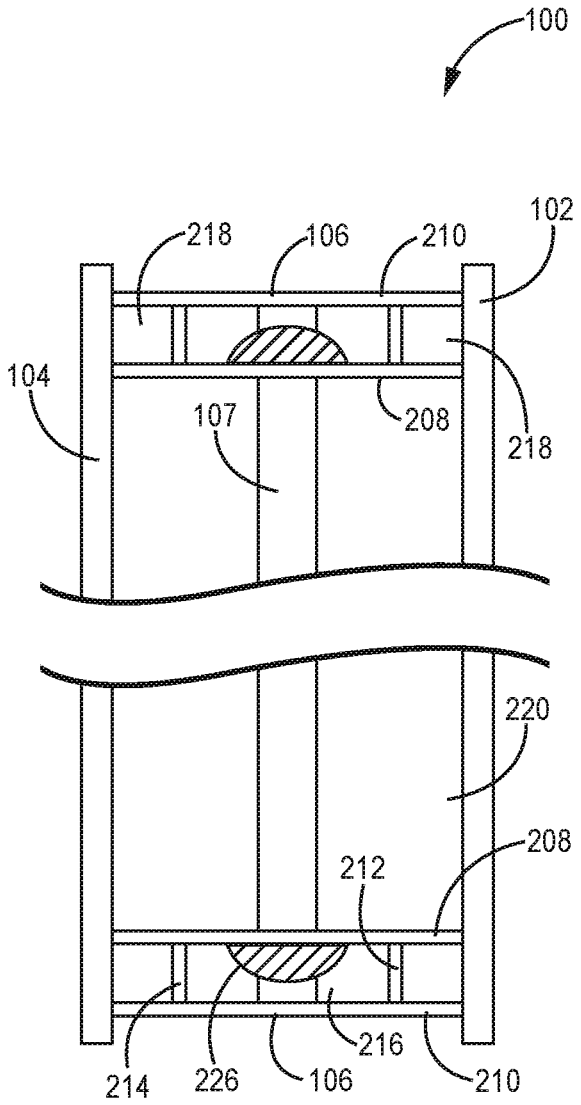
FIG. 2 is a cross-sectional view of the window assembly of FIG. 1, according to some embodiments.

FIG. 1 shows a perspective view of a window assembly 100, according to some embodiments. The window assembly 100 can include a first sheet 102 and a second sheet 104. The window assembly 100 can include a spacer 106 disposed between the first sheet 102 and the second sheet 104. In some embodiments, the spacer 106 is slightly inset from the perimeter of the first sheet 102 and the second sheet 104. FIGS. 1 and 2 show an example of the spacer 106 being inset from the perimeter of the first sheet 102 and the perimeter of the second sheet 104. In various embodiments, the window assembly 100 can include a frame that extends around the perimeter of the first sheet 102 and the second sheet 104. The frame is not shown in FIG. 1.

The first sheet 102 and the second sheet 104 can include a translucent, transparent, or semi-transparent material, such as to allow light to pass through the two sheets 102, 104 or to allow a person to see through the two sheets 102, 104. In various embodiments, the first sheet 102 and the second sheet 104 include glass, such as a clear glass. In various embodiments, the first sheet 102 and the second sheet 104 can be similar, such that the two sheets 102, 104 have a substantially similar shape and/or size.

The spacer 106 can be coupled to the first sheet 102 and the second sheet 104. The spacer 106 can extend from the first sheet 102 to the second sheet 104, such as to define a volume 220. The volume 220 is shown in FIG. 2, which is a cross-sectional view of the window assembly of FIG. 1 in some embodiments.

The volume 220 is defined between the first sheet 102 and the second sheet 104. The spacer 106 also forms a boundary of the volume 220.

The spacer 106 is formed into a spacer frame 105 that surrounds the volume 220. The spacer frame 105 has a shape that matches the outer perimeter shape of the window assembly 100. For example, where the window assembly 100 is rectangular as in FIG. 1, the spacer frame 105 is a rectangle.

In various embodiments, the window assembly 100 can include one or more muntin bars 107. One or more muntin bars 107 can be disposed within the window, such as between the first sheet and the second sheet. Muntin bars 107 can be included in a window assembly, such as to increase the aesthetic appeal. In some window assemblies the muntin bars can be arranged in a grid, such as a one by one grid as shown in FIG. 1, including one vertical muntin bar and one horizontal muntin bar. Another example of a muntin bar grid is a three by three grid, such as a grid that includes three vertical muntin bars and three horizontal muntin bars. In some window assemblies, one or more horizontal muntin bars are included without any vertical muntin bars. In some window assemblies, one or more vertical muntin bars are included without any horizontal muntin bars. It is also possible to have muntin bars included in window assemblies that are not horizontal or vertical. It is also possible for window assemblies to include muntin bars that are curved and not linear. There are many different muntin bar configurations possible.

The muntin bars 107 can be disposed within the volume 220 defined by the first sheet 102, the second sheet 104 and the spacer 106. The muntin bars 107 can have a first end and a second end. The first end and second end can be coupled to opposite portions of the spacer 106, such that the muntin bar 107 can extend across the window assembly 100.

A spacer with the ability to have an opening punched or cut into it can be used with the technology described here in. In various embodiments, a spacer can have an opening punched, cut, or burned into the spacer, such as be punching, cutting, or burning through a portion of the spacer to define an opening. The opening can be configured to receive an end of a muntin bar. The end of the muntin bar can be inserted into the spacer through the opening. The end of the muntin bar can be retained within the spacer, such as without the use of an insert or clip that goes into the muntin bar. In some embodiments, the end of the muntin bar can be retained within the spacer without anything extending into the muntin bar, such as a clip or insert that extends partially within the spacer and partially within the muntin bar.

Figure 3:
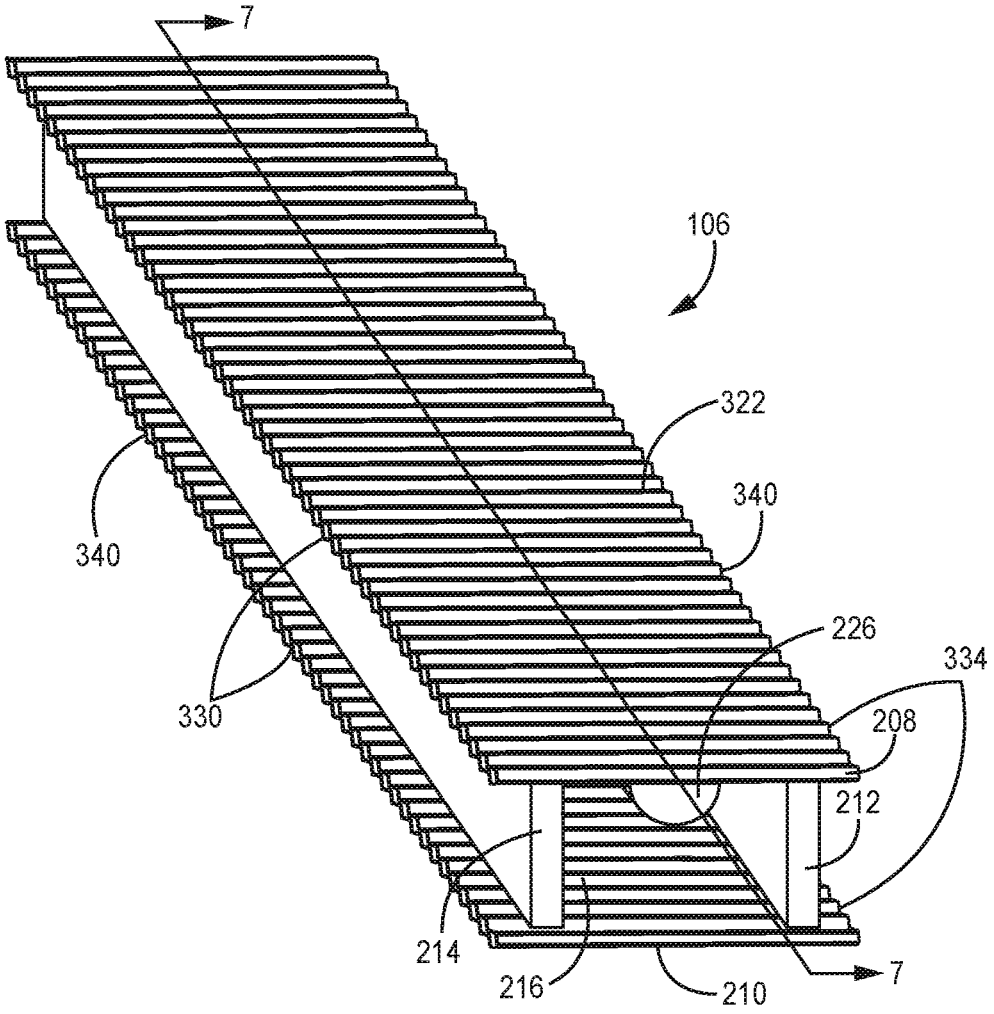
FIG. 3 is a perspective view of a spacer, according to some embodiments.

The technology described herein can be implemented with any spacer that can have an opening punched, cut, or burned into it. FIGS. 2-3 illustrate a particular embodiment of a spacer.

FIG. 2 shows a cross-section view of the window assembly 100 along line A-A in FIG. 1. The spacer 106 can include a first elongated strip 208, a second elongated strip 210, a first lateral side wall 212, and a second lateral side wall 214. The spacer 106 can define an interior space 216. In various embodiments, the interior space 216 can be at least partially occupied by a filler 226, where the filler 226 includes a desiccant. The purpose of the desiccant is to absorb moisture from the gas within the interior space 216 of the window assembly 100 in order to reduce or eliminate fogging on the interior surfaces of the first sheet 102 and second sheet 104.

The filler 226 provides a structure for retaining desiccant within the interior space 216 of the spacer 106. As a result, there is not a need for loose beaded desiccant positioned in the spacer, in many embodiments. In prior art spacers, it is common to have loose beaded desiccant positioned within the spacer.

The filler 226 is generally configured to contain/hold a desiccant material. The filler 226 can be a variety of materials and combinations of materials. In a variety of embodiments, the filler 226 holds its form and does not break apart easily. The filler 226 can generally be any type of adhesive material. As used herein, the term "adhesive material" is defined as any material that chemically hardens and is from natural or synthetic origins. Examples of synthetic substrates are acrylics, silicones, urethanes etc. Examples of natural substrates include starches, collagen, natural resin, and the like.

The filler 226 can include a matrix material, and can have a desiccant disposed within. Examples of matrix desiccants include those manufactured by W.R. Grace & Co. based in Columbia, Md. and H.B. Fuller Company based in Saint Paul, Minn. One particular example matrix material is HL-5157 produced by H.B. Fuller Company. In some embodiments, the filler 226 can incorporate beaded desiccant within or attached to the filler 226. One example is described in "SPACER HAVING A DESICCANT", U.S. 2014/0113098, filed on Oct. 21, 2013.

In a variety of embodiments, the filler 226 is also configured to provide an increased surface area exposed to the atmosphere compared to the surface area of the filler 226 in contact with a strip of a spacer. As such, the surface area of the filler 226 in contact with the elongate strip is less than the surface area of the filler 226 that is not in contact with the elongate strip. The filler 226 can be a variety of shapes, although it is depicted in the Figures as having a semi-circle cross-section. In one alternate example, the filler has a tubular cross section. Those having skill in the art will appreciate that other shapes can also be used.

In some embodiments, the first elongated strip 208 can define one or more breather holes, such as small apertures in the first elongated strip 208 that can allow gas to pass from the volume 220 between the first sheet 102 and the second sheet 104 into the interior space 216, where the gas can come into contact with the filler 226. It is also possible for gas from the volume 220 to pass into the interior space 216 through other openings, such as corner notches or muntin openings, which are further described herein.

In some embodiments of the spacer 106, the first elongated strip 208 can be parallel with the second elongated strip 210. In some embodiments, the first lateral side wall 212 can be parallel with the second lateral side wall 214. In some embodiments, the first strip 208 and the second strip 210 can be perpendicular to the first lateral side wall 212 and the second lateral side wall 214.

In various embodiments, the lateral side walls 212, 214 can be recessed from the edge of the first strip 208 and the second strip 210, such as to define an exterior space 218 along elongate edges of the spacer 106. The exterior space 218 can be separated from the interior space 216 of the spacer 106 by the lateral sidewalls 212, 214. In various embodiments, the exterior space 218 can be further bounded and defined by the first sheet 102 or the second sheet 104. In some embodiments, the exterior space 218 can be at least partially or completely filled with an adhesive or sealant, such as to adhere the spacer 106 to the first sheet 102 and/or the second sheet 104, and to adhere the first sheet 102 to the second sheet 104.

FIG. 3 shows a perspective view of a spacer 106, according to some embodiments. The spacer 106 can include a first elongated strip 208, a second elongated strip 210, a first lateral side wall 212, and a second lateral side wall 214. The first strip 208 can include a first surface 322, such as a surface that defines a portion of the volume 220 (FIG. 2) that is within the first sheet 102, second sheet 104 and spacer 106. In various embodiments, the filler 226 can be located on the first elongated strip 208, such as shown in FIG. 3.

The first and second elongate strips 208, 210 of the spacer 106 define elongate edges 330 and 334. The spacer 106 is elongate in the sense that it is much longer than it is wide. The length of a spacer 106 for a particular window assembly 100 depends on the length of the outer perimeter of the window assembly.

The first and second elongated strip 208, 210 of spacer 106 include corrugations 340. Examples of spacers including corrugations are described in the following US patent applications, which are hereby incorporated herein by reference: "SEALED UNIT AND SPACER", U.S. 2009/0120035, filed Nov. 13, 2008; "BOX SPACER WITH SIDEWALLS", U.S. 2009/0120036, filed Nov. 13, 2008; and "STRETCHED STRIPS FOR SPACER AND SEALED UNIT", U.S. 2011/0104512, filed Jul. 14, 2010.

Figure 4:
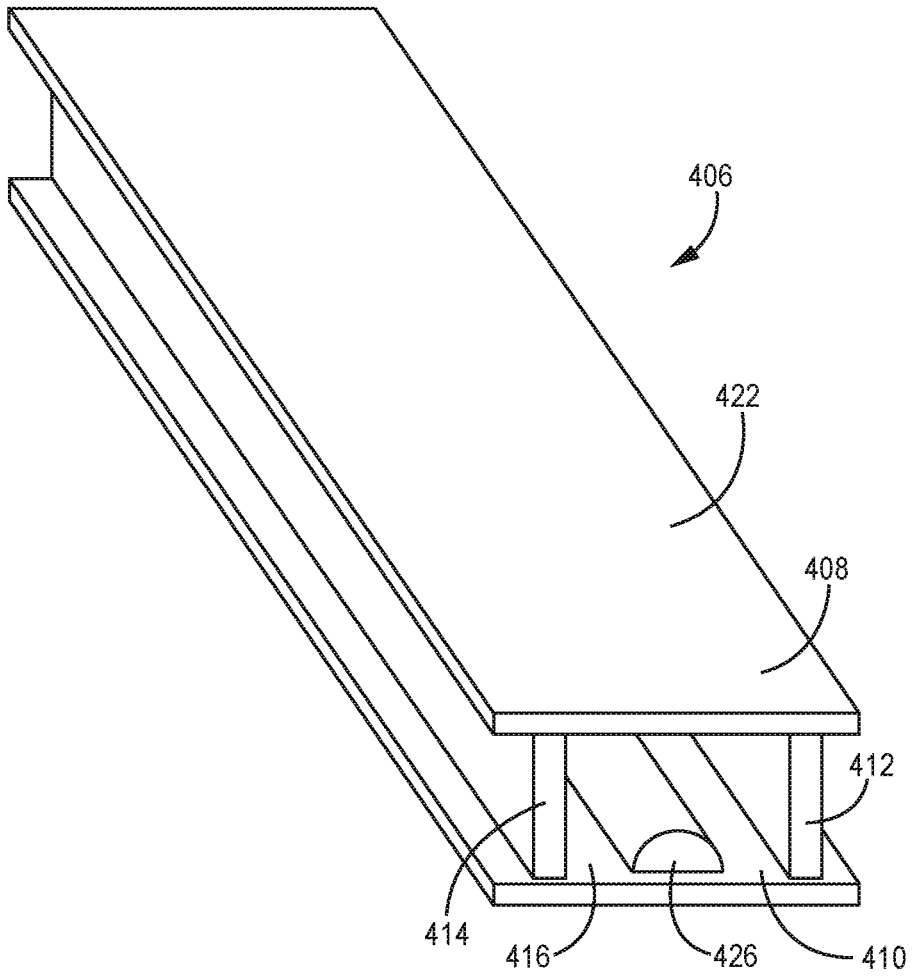
FIG. 4 is a perspective view of a spacer, according to some embodiments.

FIG. 4 shows a perspective view of an alternate spacer 406, according to some embodiments. The spacer 406 includes a first elongated strip 408, a second elongated strip 410, and lateral sidewalls 412, 414 defining an interior space 416, where the first elongated strip 408 includes a first surface 422, oriented like the similarly named parts have been described with respect to the spacer 106 of FIGS. 1-3. Unlike in spacer 106, in various embodiments, the first elongated strip 408 and second elongated strip 410 of the spacer 406 of FIG. 4 can be planar or flat and not include corrugations. The filler 426 can be located on the second elongated strip 210, such as shown in FIG. 4, rather than on the first elongated strip 408.

Figure 5:
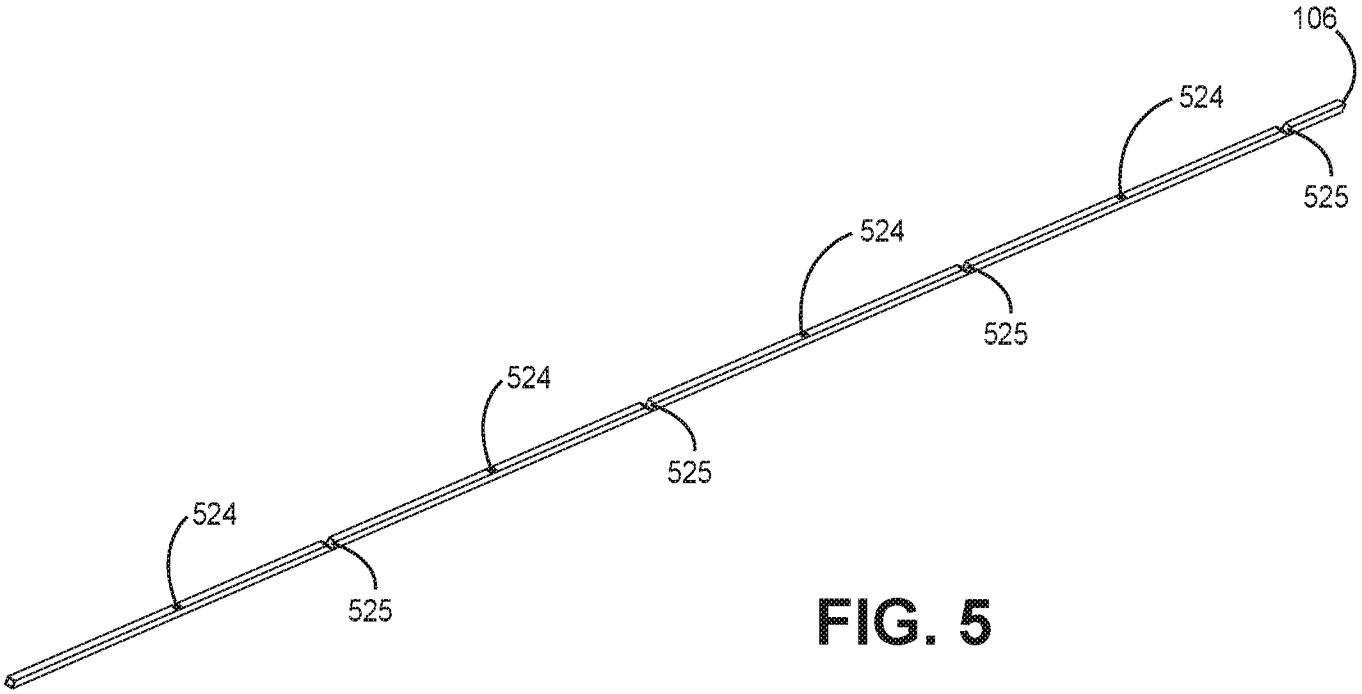
FIG. 5 is a perspective view of a spacer with muntin openings and corner notches, according to some embodiments.

FIG. 5 shows a perspective view of a spacer 106 before it is formed into a spacer frame. The spacer 106 includes with muntin openings 524, according to some embodiments. The first surface 322 can include one or more muntin opening 524. A muntin opening 524 can be configured to accept an end of a muntin bar. In various embodiments, a muntin opening 524 can be cut or burned from the first surface 322.

The spacer 106 can include or define one or more corner joints 525. The joints 525 can be configured to allow the spacer 106 to bend, such as a V-shaped notch in the spacer 106, such as to allow the spacer 106 to be bent to form a 90 degree angle. In some embodiments, the spacer 106 can include four joints 525, such that the spacer 106 can be formed into spacer frame 105 in the shape of a rectangle such as shown in FIG. 1.

In various embodiments of methods to form a window assembly 100, such as shown in FIG. 1, the spacer 106 (as shown in FIG. 5) can be configured into a spacer frame 105 of the desired shape, such as a rectangle. The spacer frame 105 can include sealant in the exterior spaces 218 along its elongate edges 330, 334. The spacer frame 105 can be adhered to the first sheet 102 by placing the one side of the spacer frame 105 against the first sheet 102 to form a spacer frame/first sheet assembly. The one or more muntin bars, such as a muntin bar grid can then be installed into the spacer frame 105, by inserting the ends of the one or more muntin bars into the muntin openings defined by the spacer 106. The installation of the one or more muntin bars into the spacer frame 105 forms a second assembly including the first sheet 102, spacer frame 105 and one or more muntin bars. The second sheet 104 can then be adhered to the second assembly by bringing the second sheet 104 into contact with the sealant in the exterior space 218 along the other side of the spacer frame 105.

Figure 6:
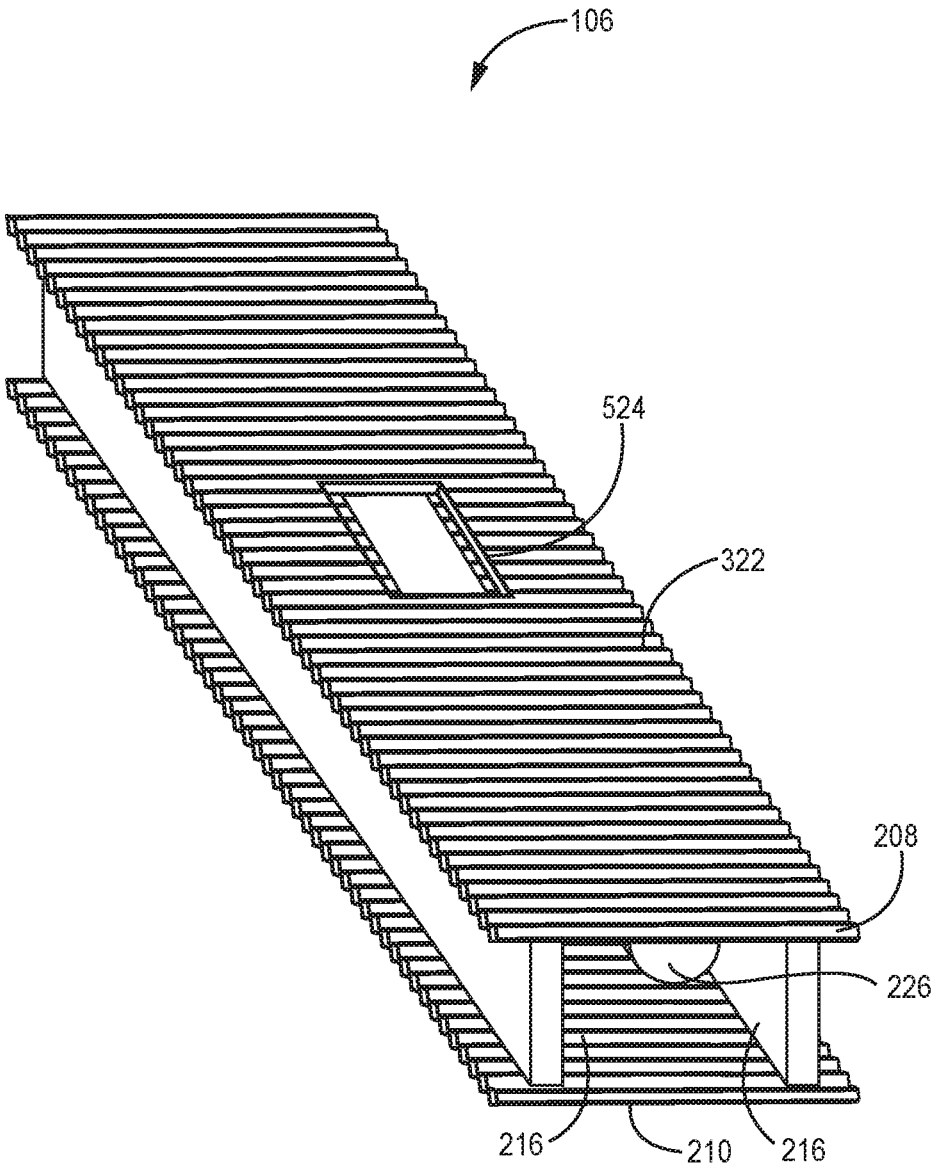
FIG. 6 is a perspective view of the spacer of FIG. 3 with a muntin opening, according to some embodiments.
Figure 11:
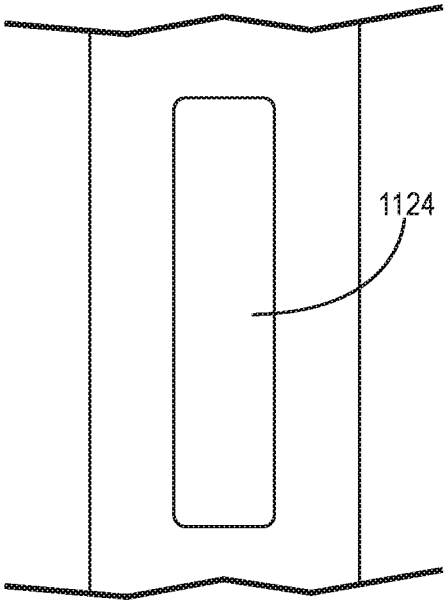
FIG. 11 is a front view of a spacer with a muntin opening, according to some embodiments.
Figure 12:
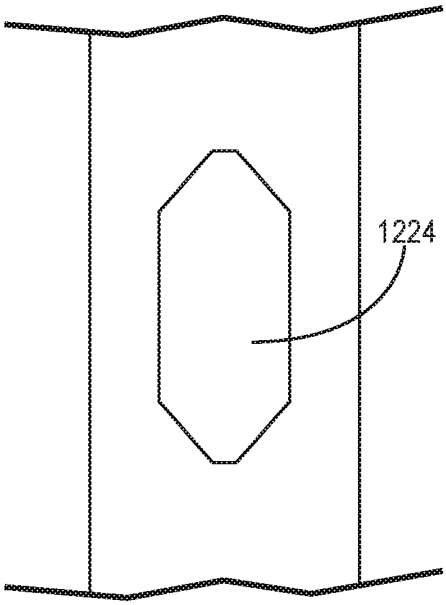
FIG. 12 is a front view of a spacer with a muntin opening, according to some embodiments.

FIG. 6 is a perspective view of a spacer 106 with a muntin opening 524, according to some embodiments. In various embodiments, the first strip 208 can define one or more apertures or openings, such as a muntin opening 524. In various embodiments, the muntin opening 524 can have a shape that is the same as or similar to the shape of the cross-section of the muntin bar that it is designed to receive. In some embodiments, the muntin opening 524 can be rectangular and can receive a rectangular muntin bar. The muntin opening 524 can have other shapes as well, corresponding to differently shaped muntin bars, such as shown in FIGS. 11 and 12.

In FIG. 6, a piece was removed from the muntin bar in order to create the muntin opening 524. As a result, the interior space 416 including the filler 226 is visible through the muntin opening 524.

In some embodiments, the muntin opening 524 can have an area of at least 0.05 square inches. In some embodiments, the muntin opening 524 can have an area of at least 0.07 square inches. In some embodiments, the muntin opening 524 can have an area of at least 0.09 square inches. In some embodiments, the muntin opening 524 can have an area of at least 0.25 square inches. In some embodiments, the muntin opening 524 can have an area of at least 0.5 square inches. In some embodiments, the muntin opening 524 can have an area of at least 1.0 square inch. In some embodiments, the muntin opening 524 can have an area of 2 square inches or less. In some embodiments, the muntin opening 524 can have an area of 1.5 square inches or less. In some embodiments, the muntin opening 524 can have an area of 1.0 square inches or less. In some embodiments, the muntin opening 524 can have an area of at least 0.10 square inches and less than 2.0 square inches. In some embodiments, the muntin opening 524 can have an area of at least 0.25 square inches and less than 2.0 square inches.

The examples provided herein for the area of the muntin opening can also be examples of areas for cross-sections of muntin bars for fitting within those same openings.

Figure 7:
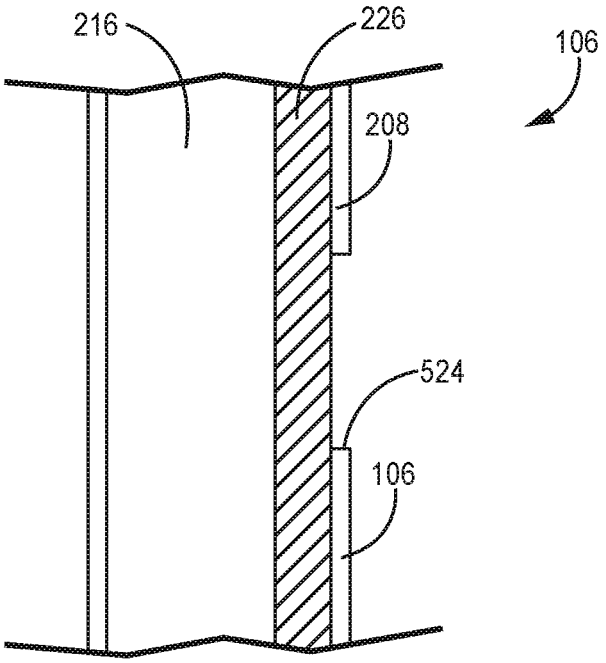
FIG. 7 is a cross-sectional view of the spacer of FIG. 6 with a muntin opening, according to some embodiments.

FIG. 7 shows a cross-sectional view of a portion of the spacer 106 with a muntin opening 524 shown in FIG. 6. The spacer 106 can define an interior space 216 including a filler 226. In FIG. 7, the muntin opening 524 has already been cut into the spacer 106 but a muntin bar has not yet been placed into the muntin opening 524. In various embodiments, a filler 226 can be disposed within the interior space 216. In some embodiments, the filler 226 occupies at least 25% of the interior space 216. In other embodiments, the filler 226 can occupy at least 50%, 75%, 85%, or 95% of the interior space.

Figure 8:
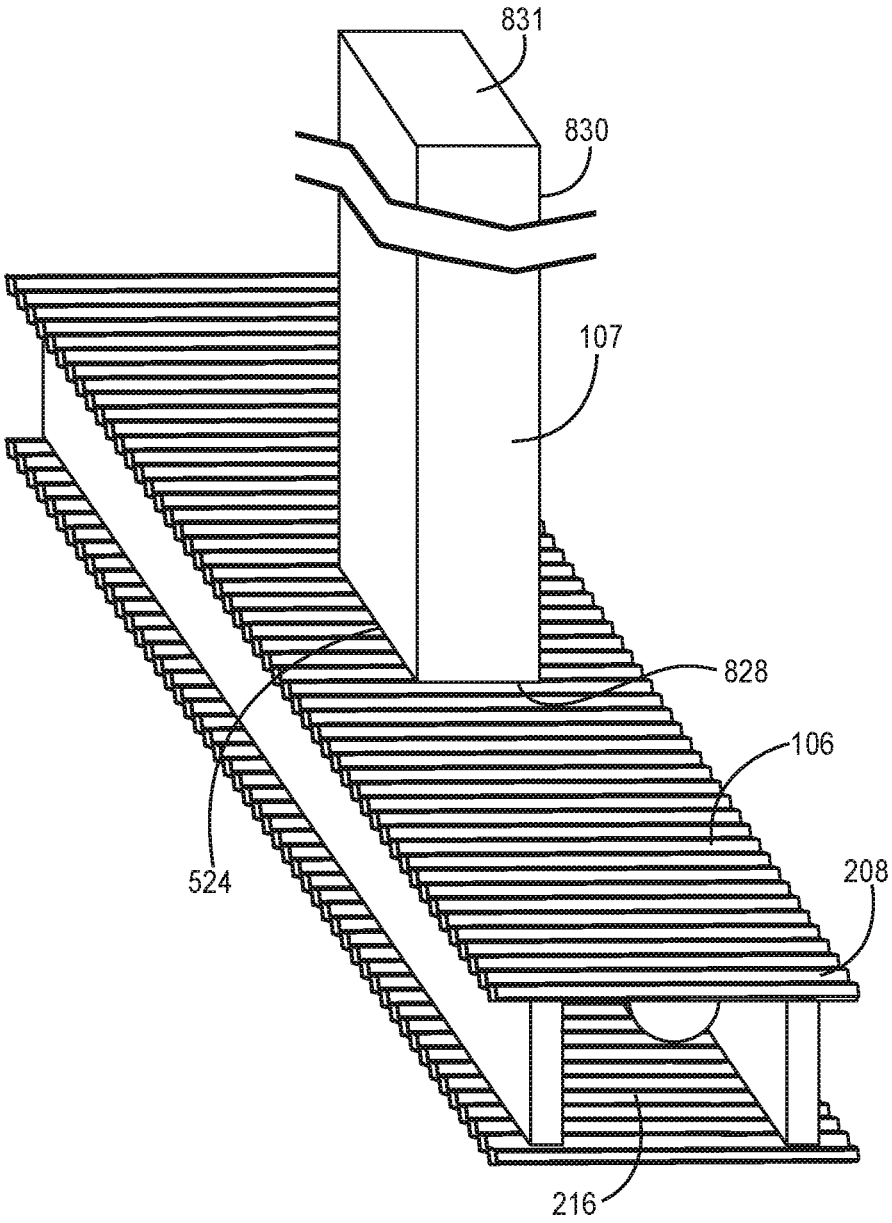
FIG. 8 is a perspective view of a spacer and muntin bar, according to some embodiments.

FIG. 8 shows a perspective view of a spacer 106 and muntin bar 107, according to some embodiments, after the muntin bar 107 is positioned within the muntin opening 524. The muntin bar 107 can include a first end region 828 including a first end and a second end region 830 including a second end 831. The muntin bar 107 can at least partially extend through the muntin opening 524, such that at least a portion of the first end region 828 or second end region 830 extends through or is positioned within the muntin opening 524. The first end region 828 can be at least partially positioned within the muntin opening 524. The first end region 828 can be at least partially disposed within the interior space 216.

The muntin bar 107 can be perpendicular to the spacer 106. In other embodiments, the muntin bar 107 is not perpendicular to the spacer 106. In various embodiments, the first end region 828 is located within a first muntin opening 524 and a second end region 830 is located within a muntin opening 524 in the spacer frame across from the first muntin opening. The second muntin opening 524 can be located across or on the opposite side of the volume 220, such as shown in FIG. 1. It should be understood that the embodiments described throughout this document can be associated with the second end of a muntin bar, as well as the first end of the muntin bar, such as the second end being disposed within a spacer across from the first end in a similar manner.

Figure 9:
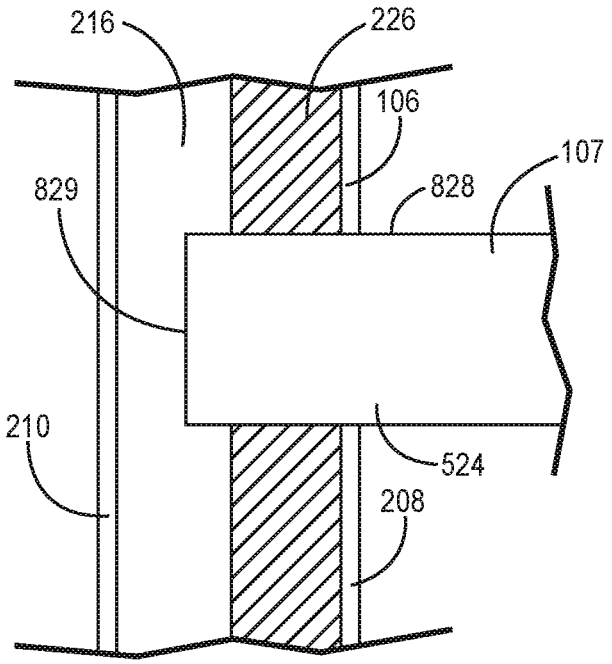
FIG. 9 is a cross-sectional view of the spacer and muntin bar of FIG. 8, according to some embodiments.
Figure 10:
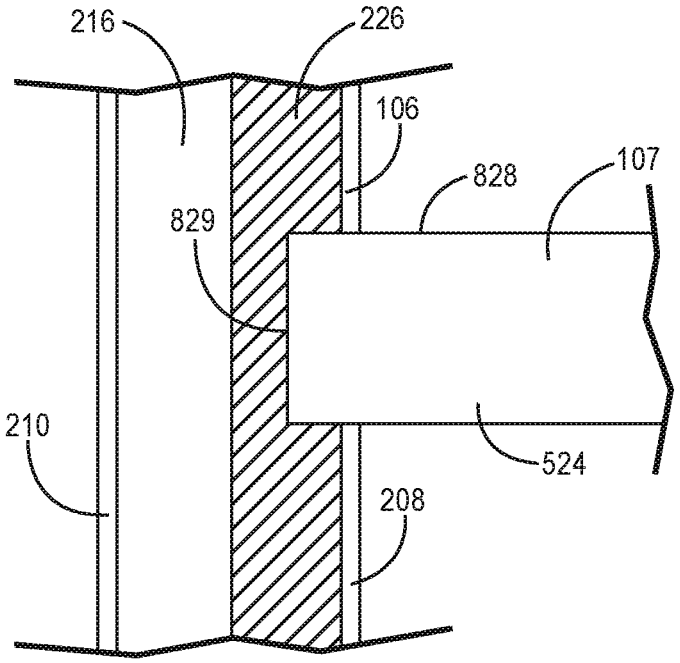
FIG. 10 is a cross-sectional view of a spacer and a muntin bar of FIG. 8, according to some embodiments.

FIG. 9 shows a cross-sectional view of the spacer 106 and muntin bar 107 in FIG. 8. The muntin bar 107 can have a first end region 828 that is positioned within the muntin opening 524 of the spacer 106. In the example of FIG. 9, the end region 828 of the muntin bar 107 terminates at an end 829 which is between the first elongated strip 208 and the second elongated strip 210. In some embodiments, the first end 829 can be located within or adjacent to filler 226, such as shown in FIG. 10. In some embodiments, the first end region 828 can extend through the interior space 216 and the first end 829 can contact the second elongated strip 210. In other embodiments, the first end region 828 can terminate adjacent to the second elongated strip 210, such as to leave a small space between the first end 829 and the second elongated strip 210. In some embodiments, the first end region 828 can terminate at end 829 between the filler 226 and the second elongated strip 210. In some embodiments, the first end 829 is positioned at 10% of the distance from the first elongated strip 208 to the second elongated strip 210. In other embodiments, the first end 829 is positioned at 20%, 25%, 30%, 40%, 50%, 60%, 70%, 75%, 80% or 90% of the way through the distance from the first elongated strip 208 to the second elongated strip 210.

As discussed above, the muntin opening can have many different shapes. FIGS. 11 and 12 show front views of spacers with different shaped muntin openings. As shown in FIG. 11, a muntin opening 1124 can define an elongated rectangle shape. As shown in FIG. 12, a muntin opening 1224 can define a non-regular shape, such as a non-regular octagon. It should be understood that other shapes are also possible, such as a triangle, a rectangle, a diamond, a pentagon, a hexagon, or a contour shape.

Figure 13:
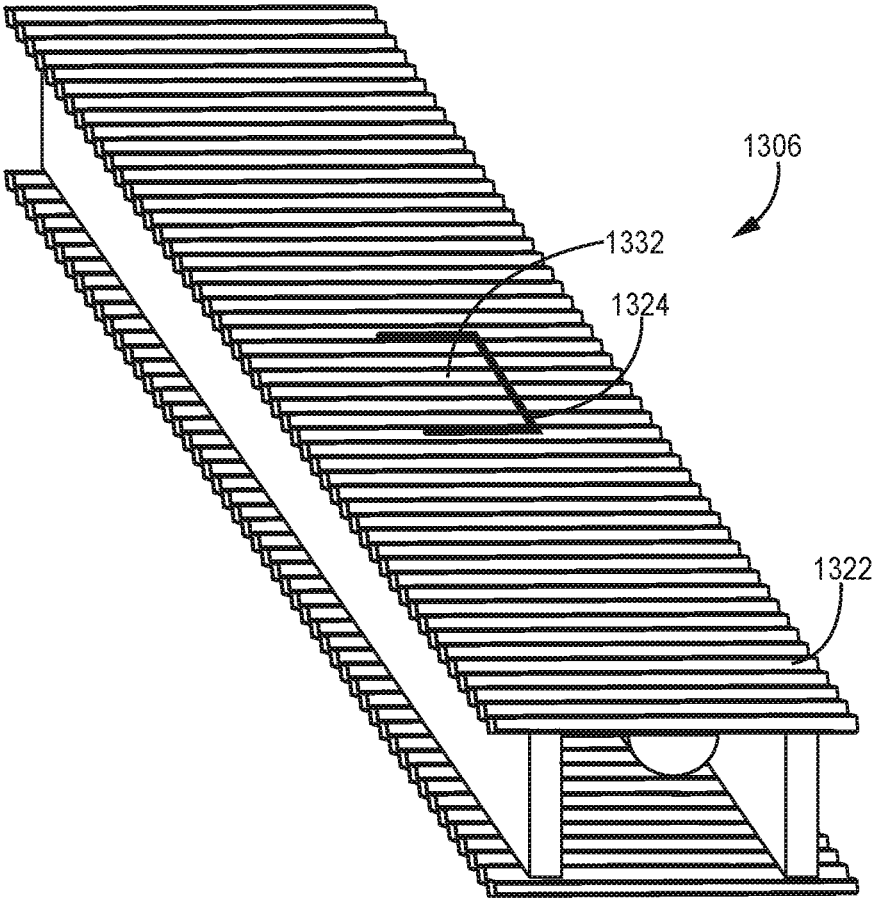
FIG. 13 is a perspective view of a spacer with a muntin opening, according to some embodiments.

FIG. 13 shows a perspective view of a spacer 1306 with a muntin opening 1324. FIG. 13 shows the flap 1332 in an example of a first position where the flap is level with the first surface. In various embodiments, the muntin opening 1324 can be covered by a portion of the first surface, such as a flap 1332. The flap 1332 can include a portion of the first surface 1322. The flap 1332 can be defined simultaneously with defining the muntin opening 1324, such as when cutting the first surface 1322. In some embodiments, the flap 1332 can be attached to the first surface 1322, such as by not entirely separating the flap 1332 from the first surface 1322 when defining the muntin opening 1324.

In various embodiments, the flap 1332 and the muntin opening 1324 can be defined by three linear cuts, such as shown in FIG. 13. A cut can refer to a separation between two adjacent portions of a surface. In various embodiments, the two adjacent portions of the surface were at one time not separated. In some embodiments, the flap 1332 can be defined by a single cut, such as an arc or a non-linear cut. In some embodiments, the flap 1332 can be defined by a plurality of linear cuts, a plurality of non-linear cuts, or a plurality of linear and non-linear cuts.

Figure 14:
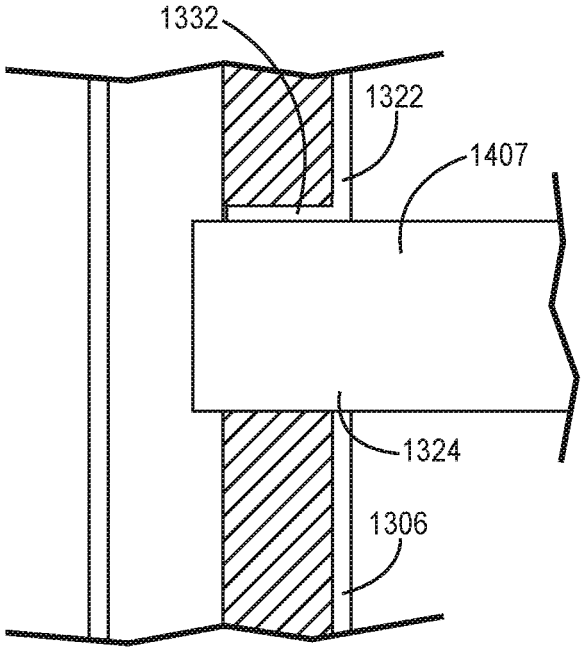
FIG. 14 is a cross-sectional view of the spacer with a muntin opening of FIG. 13 with a muntin bar, according to some embodiments.

FIG. 14 shows a cross-section view of a spacer 1306 defining a flap 1332 in the first surface 1322 of the spacer 1306. FIG. 14 shows the flap 1332 in an example of a second position where the flap has been bent down in an interior space defined by the spacer 1306. The flap 1332 is bent in to accommodate a muntin bar 1407 positioned partially within an interior space of the spacer 1306. In some embodiments, when the first end of the muntin bar is pushed through the muntin opening 1324 and into the interior space, the muntin bar can push or move the flap 1332 into the interior space thereby, allowing the muntin bar to extend through the muntin opening. A perspective view of the spacer 1306 and muntin bar 1407 would appear similar to FIG. 8.

As shown in FIG. 14, the flap 1332 can be located within the interior space, such as when the muntin bar 1307 is extending through the muntin opening. In various embodiments, the flap 1332 can be located within the interior space and can be adjacent to the first end of the muntin bar 1407. In some embodiments, the flap 1332 can be located within the interior space and can be in contact with a portion of the first end of the muntin bar 1407. In some embodiments, the flap 1332 can be located within the interior space and can be parallel to the muntin bar 1407.

Figure 15:
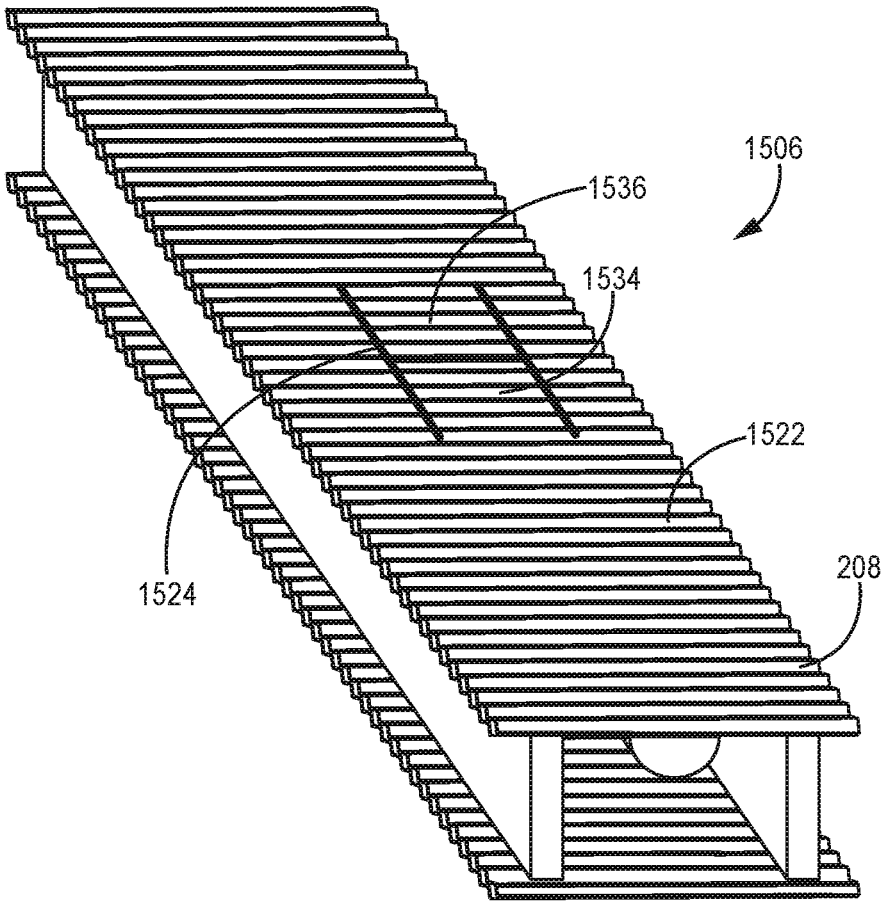
FIG. 15 is a perspective view of a spacer with a muntin opening, according to some embodiments.

In some embodiments, the muntin opening can be covered or substantially covered by more than one flap, such as prior to the muntin bar being inserted through the muntin opening. FIG. 15 shows a perspective view of a spacer with a muntin opening substantially covered by a portion of the first strip 208, such as two flaps (a first flap 1534 and a second flap 1536), according to some embodiments. The first flap 1534 and the second flap 1536 can be substantially similar. For example, the first flap 1534 and the second flap 1536 can have the same shape and/or size.

The first flap 1534 and second flap 1536 can include a portion of the first surface 1522. The first flap 1534 and second flap 1536 can be defined simultaneously with defining the muntin opening 1524, such as when cutting the first surface 1522. In some embodiments, the first flap 1534 and second flap 1536 can be attached to the first surface 1522, such as by not entirely separating the flaps 1534, 1536 from the first surface 1522 when defining the muntin opening 1524.

Figure 16:
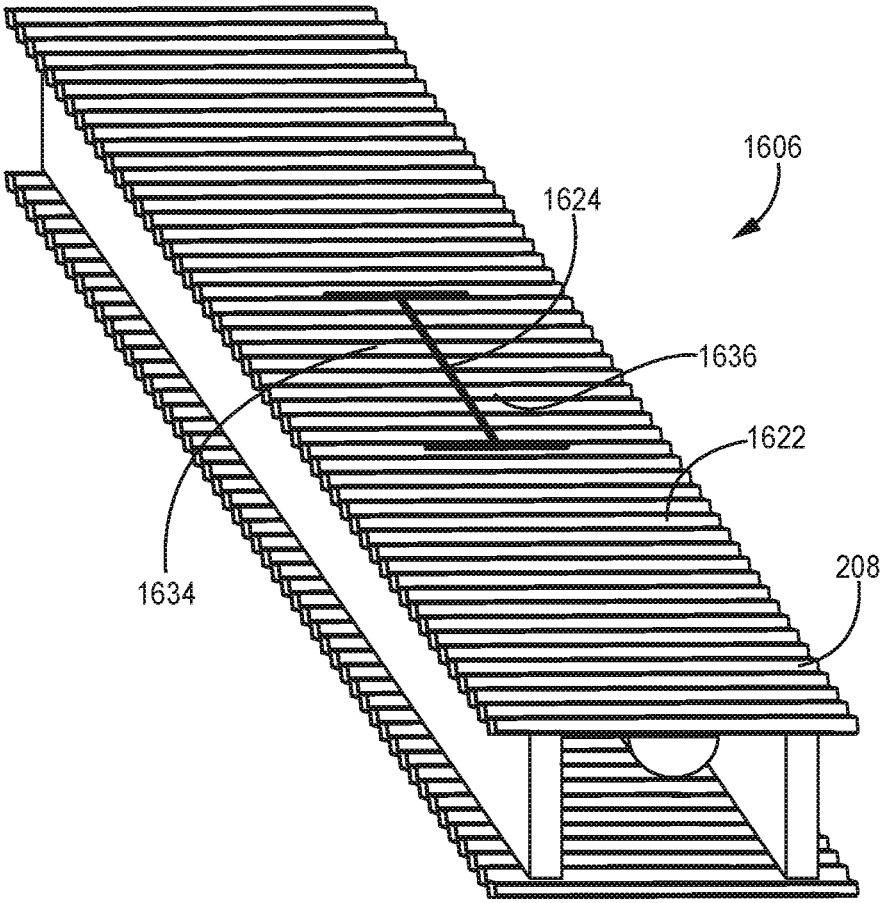
FIG. 16 is a perspective view of a spacer with a muntin opening, according to some embodiments.

In various embodiments, the flaps 1534, 1536 can be defined by three linear cuts, such as shown in FIG. 15 or FIG. 16. A cut can refer to a separation between two adjacent portions of a surface. In various embodiments, the two adjacent portions of the surface were at one time not separated. In some embodiments, the flaps 1534, 1536 can be defined by a single cut, such as an arc cut, a non-linear cut or an H-shaped cut. In some embodiments, the flaps 1534, 1536 can be defined by a plurality of linear cuts, a plurality of non-linear cuts, or a plurality of linear and non-linear cuts.

FIG. 16 shows a perspective view of a spacer 1606 with a muntin opening 1624 where a first surface 1622 defines two flaps 1634, 1636, but with different shape and orientation than the flaps of FIG. 15. FIG. 16 shows a first flap 1634 and a second flap 1636 rotated 90 degrees from FIG. 15. In some embodiments, the separation between the first flap 1634 and the second flap 1636 can be parallel with the length of the spacer 1606, such as shown in FIG. 16. In some embodiments, the separation between the first flap 1534 and the second flap 1536 can be perpendicular to the length of the spacer 1506, such as shown in FIG. 15.

Figure 17:
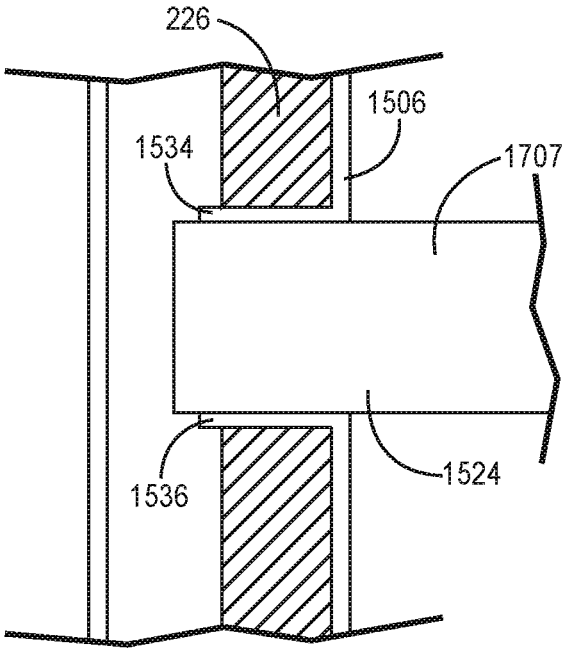
FIG. 17 is a cross-sectional view of the spacer with a muntin opening of FIG. 15 with a muntin bar, according to some embodiments.

FIG. 17 shows a cross-section view of a spacer 1506 and a muntin bar 1707. In some embodiments, as the first end of the muntin bar is positioned through the muntin opening 1524 and into the interior space, the muntin bar 1707 can push or move the flaps 1534, 1536 into the interior space thereby allowing the muntin bar to extend through the muntin opening 1524. A perspective view of the spacer 1506 and muntin bar 1707 can be similar to FIG. 8 in some embodiments.

As shown in FIG. 17, the flaps 1534, 1536 can be located within the interior space, such as when the muntin bar 1707 is extending through the muntin opening 1524. The first flap 1534 can be on the opposite side of the muntin bar 1707 from the second flap 1536. In various embodiments, the first flap 1534 and the second flap 1536 can be located within the interior space and can be adjacent to the first end of the muntin bar 1707. In some embodiments, the flaps 1534, 1536 can be located within the interior space and can be in contact with a portion of the first end of the muntin bar 1707. In some embodiments, the flaps 1534, 1536 can be located within the interior space and can be parallel to the muntin bar 1707.

Figure 18:
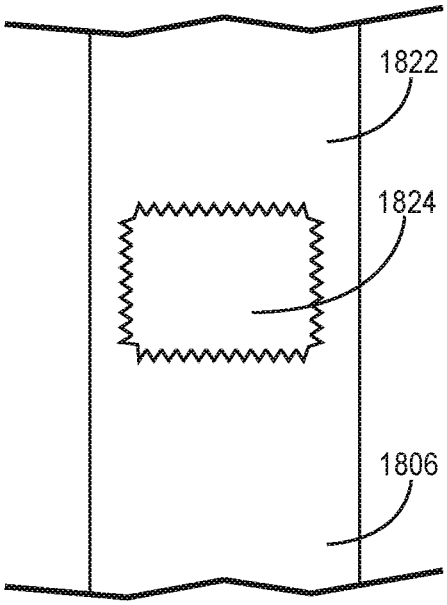
FIG. 18 is a perspective view of a spacer with a muntin opening, according to some embodiments.

FIG. 18 shows a front view of a spacer 1806 with a muntin opening 1824, according to some embodiments. In some embodiments, at least one edge of the first surface 1822 that defines the muntin opening 1824 can be serrated. The serrated edge or edges can aid in coupling the spacer 1806 with a muntin bar. A serrated edge can include a plurality of peaks and valleys, such as alternating peaks and valleys. In various embodiments, the peaks can be sharp peaks, such as where the peaks are not rounded.

Figure 19:
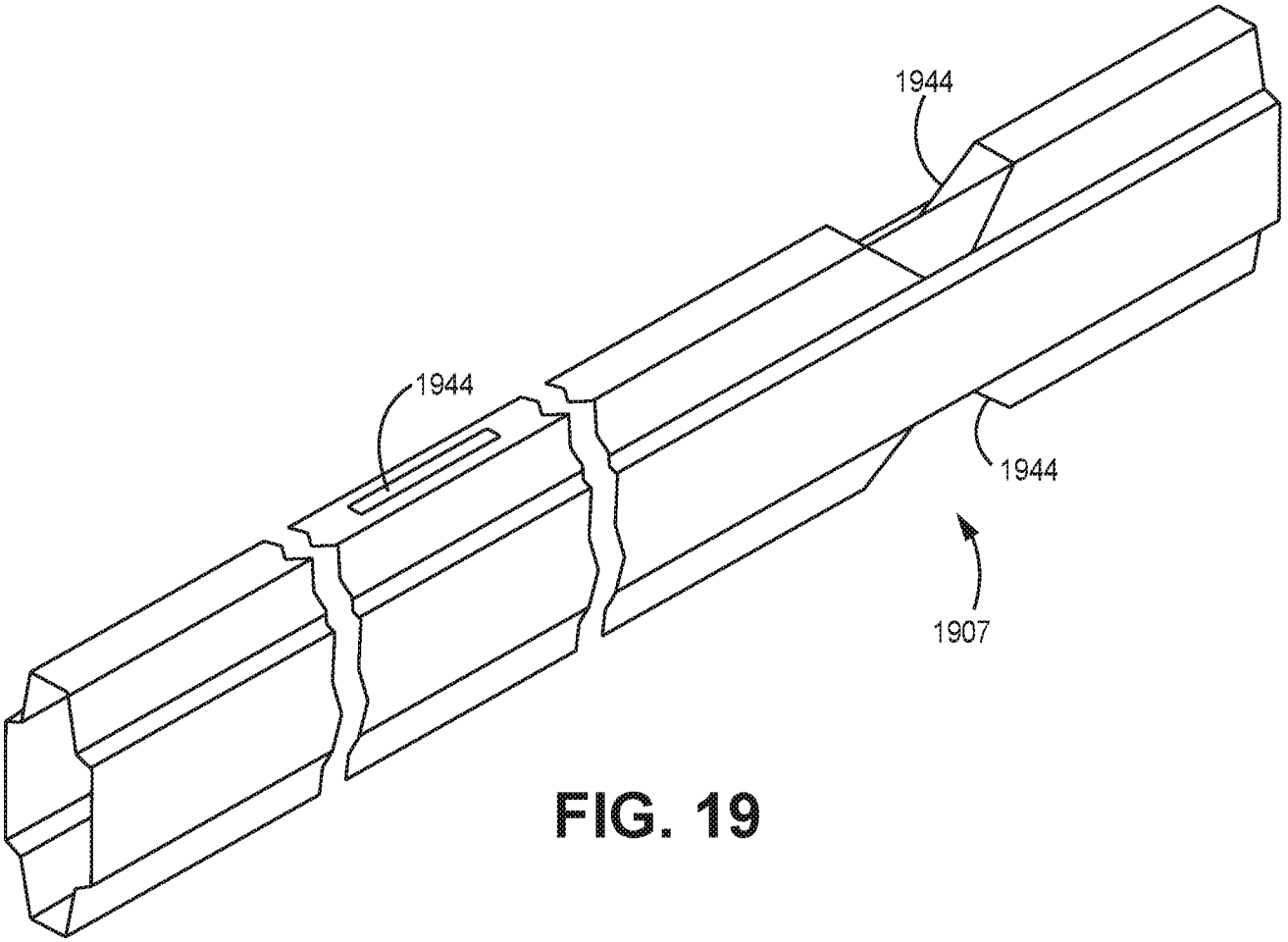
FIG. 19 is a perspective view of a muntin bar, according to some embodiments.

FIG. 19 shows a perspective view of a muntin bar 1907, according to some embodiments. In some embodiments, the muntin bar 1907 can define one or more grid attachment elements 1944. The grid attachment elements 1944 can aid in coupling multiple muntin bars 1907 together, such as to form a grid. In some embodiments, the muntin bar 1907 can be hollow, such as defining an inner cavity.

Figure 20:
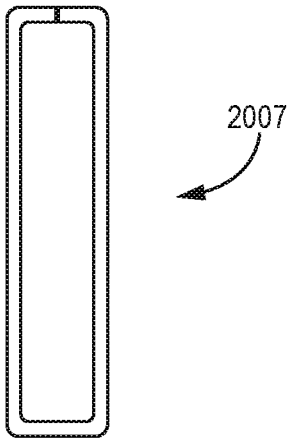
FIG. 20 is a cross-section view of a muntin bar, according to some embodiments.
Figure 21:
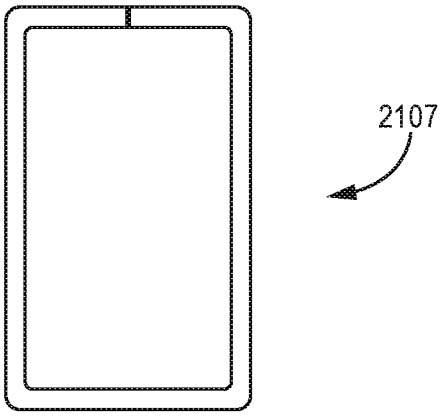
FIG. 21 is a cross-section view of a muntin bar, according to some embodiments.
Figure 22:
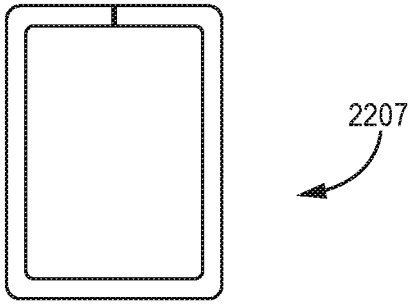
FIG. 22 is a cross-section view of a muntin bar, according to some embodiments.
Figure 23:
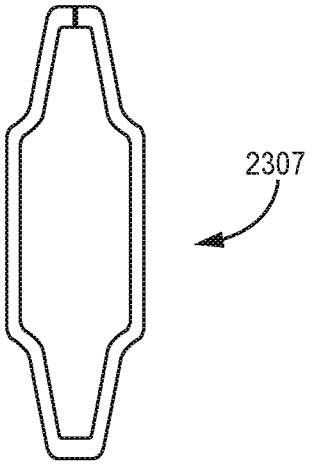
FIG. 23 is a cross-section view of a muntin bar, according to some embodiments.
Figure 24:
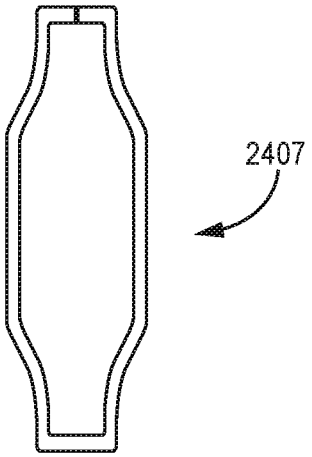
FIG. 24 is a cross-section view of a muntin bar, according to some embodiments.
Figure 25:
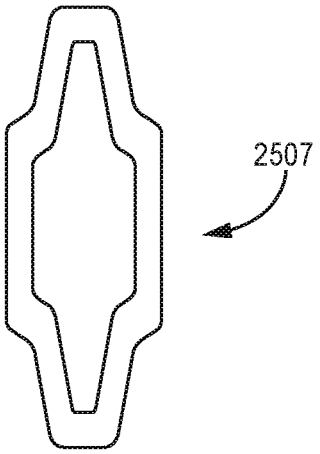
FIG. 25 is a cross-section view of a muntin bar, according to some embodiments.
Figure 26:
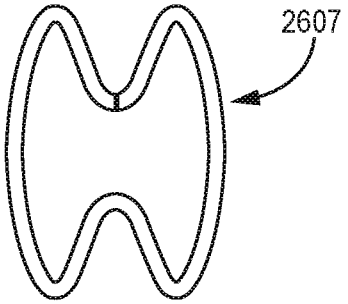
FIG. 26 is a cross-section view of a muntin bar, according to some embodiments.

FIGS. 20-26 show cross-section views of different muntin bars. FIGS. 20-22 show cross-section views of rectangular muntin bars 2007, 2107, 2207, each with a different width to height ratio. The rectangular muntin bar shown in FIG. 20 could fit into the opening 1124 of FIG. 11, for example. FIGS. 23-25 show cross-section views of non-regular octagon-shaped or non-regular polygon muntin bars 2307, 2407, 2507, which are sometimes referred to as contour-shaped muntin bars. The contour-shaped muntin bars 2307, 2407, 2507 could fit into the muntin opening 1224 shown in FIG. 12, for example. FIG. 26 shows a cross-section view of a non-regular shaped muntin bar 2607. It should be understood that muntin bars with alternative shapes would be consistent with the technology described herein.

Figure 27:
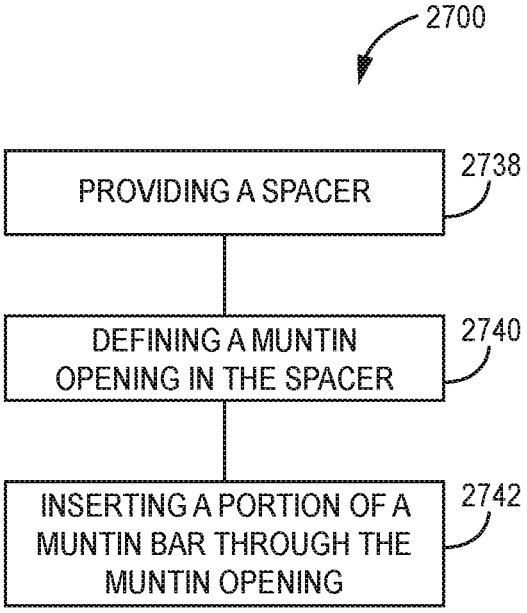
FIG. 27 is a flow chart of a method, according to some embodiments.

FIG. 27 is a flow chart of a method 2700 of assembling a spacer and a muntin bar, according to some embodiments. In step 2738, a spacer can be provided. In various embodiments, the method 2700 can include providing a spacer, such as an element to maintain a space or gap between two panes in a window assembly.

The method 2700 can include cutting a muntin opening in a first strip of the spacer, step 2740. The muntin opening can be configured to receive the first end of a muntin bar. The muntin opening can be configured to have the first end of the muntin bar extend past the first strip and into an interior space defined by the spacer. In some embodiments, cutting the muntin opening can define a flap that covers the majority of the muntin opening. In some embodiments, cutting the muntin opening can define a first flap and a second flap that cover the majority of the muntin opening. In some embodiments, the spacer can be cut with a laser to define the muntin opening. In some embodiments, the spacer can be cut with a water jet to define the muntin opening.

The method 2700 can include inserting the first end of the muntin bar into the muntin opening, step 2742. In some embodiments, inserting the first end of the muntin bar into the muntin opening can include pressing or pushing the first flap into the interior space of the spacer. In some embodiments, inserting the first end of the muntin bar into the muntin opening can include pressing or pushing the first flap and the second flap into the interior space of the spacer.

In some embodiments, the method 2700 can include removing at least some debris from the spacer or muntin bar, such as debris that results from cutting the muntin bar opening. In some embodiments, the debris can be removed with a vacuum.

Where a window unit includes a muntin bar grid, the grid may be assembled before the ends of the individual muntin bars are positioned within the muntin openings of the spacer, in some embodiments.

Now referring to FIGS. 1-2, optional aspects of assembling a window assembly include forming a spacer frame that defines a closed perimeter, where the spacer frame defines a plurality of muntin bar openings corresponding to the number of muntin bar ends. The spacer frame is then affixed to a first sheet material. Then, the desired muntin bar arrangement is positioned in the muntin bar openings. The desired muntin bar arrangement can be a single muntin bar, a plurality of muntin bars or a muntin bar grid. Then, a second sheet is attached to the spacer to form an insulated unit that defines an internal space.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this technology pertains. All publications and patent applications are herein incorporated by reference to the same extent as if each individual publication or patent application was specifically and individually indicated by reference.

The technology has been described with reference to various specific and preferred embodiments and techniques. However, it should be understood that many variations and modifications may be made while remaining within the spirit and scope of the technology.

The invention claimed is:

1. A window assembly comprising:

a first sheet of a translucent, transparent or semi-transparent material;

a second sheet of a translucent, transparent or semi-transparent material;

a spacer extending from the first sheet to the second sheet and comprises at least a first elongated strip having a first surface and wherein the spacer defines a muntin opening in the first surface of the first strip, wherein a portion of the first elongated strip defines a first flap portion, wherein the first flap portion has a first position where the first flap portion is level with the first surface and a second position where the first flap portion is bend down into an interior space defined by the spacer; and a muntin bar having a first end that is positioned within the muntin opening of the spacer.

2. The window assembly of claim 1, wherein the spacer further comprises at least one filler positioned within the interior space of the spacer, the filler including a desiccant.

3. The window assembly of claim 2, wherein the desiccant is a beaded desiccant.

4. The window assembly of claim 1, wherein the muntin opening surrounds an entire perimeter of the muntin bar.

5. The window assembly of claim 1, wherein when the first flap portion is in the second position, the first flap portion is adjacent to the first end of the muntin bar.

6. The window assembly of claim 1, wherein the spacer comprises a second flap portion extending from the first surface at the muntin opening, wherein the second flap portion has a first position where the flap portion is level with the first surface and a second position where the flap portions is bent down into the interior space.

7. The window assembly of claim 6, wherein the first flap portion and the second flap portion are substantially similar.

8. The window assembly of claim 1, wherein a shape of a cross-section of the muntin bar is similar to a shape of the muntin opening.

9. The window assembly of claim 1, wherein muntin opening is at least 0.07 square inches.

10. A spacer comprising at least a first elongated strip having a first surface, wherein the spacer defines at least part of a muntin opening in the first surface of the first strip, wherein a portion of the first elongated strip defines a flap portion, wherein the flap portion has a first position where the flap portion is level with the first surface and a second position where the flap portion is bent down into an interior space defined by the spacer.

11. The spacer of claim 10, defining an interior space and at least one filler positioned within the interior space of the spacer, the filler including a desiccant.

12. The spacer of claim 11, wherein the desiccant is a beaded desiccant.

13. The spacer of claim 10, wherein the at least part of a muntin opening comprises three sides of a rectangle to define the flap portion.

14. The spacer of claim 10, wherein the muntin opening is covered by the portion of the first strip when the flap portion is in the first position.

15. A method of assembling a window assembly including a first muntin bar, comprising:

providing a spacer comprising at least a first elongated strip having a first surface;

cutting at least a part of a perimeter of a muntin opening in the first strip of the spacer to define a first flap portion in the elongated strip, wherein the first flap portion has a first position where the first flap portion is level with the first surface and a second position where the flap portion is bend down into an interior space defined by the spacer; and inserting the first end of the first muntin bar into the muntin opening.

16. The method of claim 15, wherein inserting the first end of the first muntin bar into the muntin opening moves the first flap portion into the second position.

17. The method of claim 15, further comprising:

removing at least some debris from the window assembly, wherein the debris is a result from cutting the first muntin bar opening.

18. The method of claim 15, further comprising the step of assembling a muntin bar grid from a plurality of muntin bars including the first muntin bar, wherein the step of cutting comprises cutting a plurality of muntin openings in the first elongated strip of the spacer, wherein a number of muntin openings equals a number of muntin bar ends present in the muntin bar grid, wherein the step of inserting further comprises inserting each of the muntin bar ends into one of the plurality of muntin openings.

* * * * *